US012305371B1

(12) United States Patent
Qiu

(10) Patent No.: US 12,305,371 B1
(45) Date of Patent: May 20, 2025

(54) FAUCET

(71) Applicant: WENZHOU FURUISI BUILDING MATERIALS CO., LTD., Wenzhou (CN)

(72) Inventor: Chunhe Qiu, Wenzhou (CN)

(73) Assignee: WENZHOU FURUISI BUILDING MATERIALS CO., LTD., Wenzhou (CN)

( * ) Notice: Subject to any disclaimer, the term of this patent is extended or adjusted under 35 U.S.C. 154(b) by 0 days.

(21) Appl. No.: 18/785,265

(22) Filed: Jul. 26, 2024

(30) Foreign Application Priority Data

Jan. 18, 2024 (CN) ..... 202420131654.7
Jan. 18, 2024 (CN) ..... 202420131836.4

(51) Int. Cl.
*E03C 1/04* (2006.01)

(52) U.S. Cl.
CPC ..... *E03C 1/0403* (2013.01); *E03C 1/0404* (2013.01); *E03C 2001/0418* (2013.01)

(58) Field of Classification Search
CPC ..... E03C 1/0403; E03C 1/0404; E03C 2001/0418
USPC ..... 4/675–678; 137/801
See application file for complete search history.

(56) References Cited

U.S. PATENT DOCUMENTS

2005/0135099 A1* 6/2005 Stuhlmacher ..... E03C 1/0404 362/253
2011/0126932 A1* 6/2011 Chan ..... F16K 11/0746 137/801

FOREIGN PATENT DOCUMENTS

DE 102012014947 A1 * 1/2014 ..... E03C 1/0404

* cited by examiner

*Primary Examiner* — Tuan N Nguyen
(74) *Attorney, Agent, or Firm* — Daniel M. Cohn

(57) ABSTRACT

A faucet includes a water inlet assembly, a water outlet assembly, and a display assembly. The water inlet assembly includes a water inlet pipe. The water outlet assembly includes a water outlet pipe. The water outlet pipe is connected to the water inlet pipe. The water outlet pipe is communicated with the water inlet pipe. The display assembly includes a light-transmitting component and a light-emitting component. The light-emitting component is disposed in the light-transmitting component, and the light-transmitting component is mounted on an outer surface of the water inlet pipe and/or an outer surface of the water outlet pipe. A light-transmitting surface of the light-transmitting component is exposed.

18 Claims, 15 Drawing Sheets

FAUCET

TECHNICAL FIELD

The present disclosure relates to a technical field of faucets, and in particular to a faucet.

BACKGROUND

A faucet assembly generally comprises a hot water outlet assembly, a cold water outlet assembly, and a mixed water outlet assembly. The mixed water outlet assembly is connected to the hot water outlet assembly and the cold water outlet assembly respectively. For example, the mixed water outlet assembly is connected to the hot water outlet assembly through a first water pipe, and the mixed water outlet assembly is connected to the cold water outlet assembly through a second water pipe.

The mixed water outlet assembly generally comprises a water inlet pipe, a water outlet pipe, a connecting pipe, and a sleeve. A first end of the connecting pipe is connected to the water inlet pipe, a second end of the connecting pipe is connected to a first end of the sleeve, and a second end of the sleeve is connected to the water outlet pipe. In an actual mounting process of the faucet assembly, the mixed water outlet assembly is prone to water leakage due to joints in the mixed water outlet assembly.

SUMMARY

The present disclosure provides a faucet having excellent waterproof performance.

The faucet comprises a water inlet assembly, a water outlet assembly, and a display assembly.

The water inlet assembly comprises a water inlet pipe. The water outlet assembly comprises a water outlet pipe. The water outlet pipe is connected to the water inlet pipe. The water outlet pipe is communicated with the water inlet pipe.

The display assembly comprises a light-transmitting component and a light-emitting component. The light-emitting component is disposed in the light-transmitting component, and the light-transmitting component is mounted on an outer surface of the water inlet pipe and/or an outer surface of the water outlet pipe. A light-transmitting surface of the light-transmitting component is exposed.

In a mounting process of the faucet of the present disclosure, the water inlet pipe and the water outlet pipe are directly sleeved with each other, so that joints of the water inlet pipe and the water outlet pipe are reduced compared with a faucet in the prior art, and the waterproof performance of the faucet is improved.

BRIEF DESCRIPTION OF DRAWINGS

For a more complete understanding of the present disclosure and technical effects thereof, the following description is made with reference to the accompanying drawings, in which same reference numerals refer to same parts in the following description.

DETAILED DESCRIPTION

Figure 1:
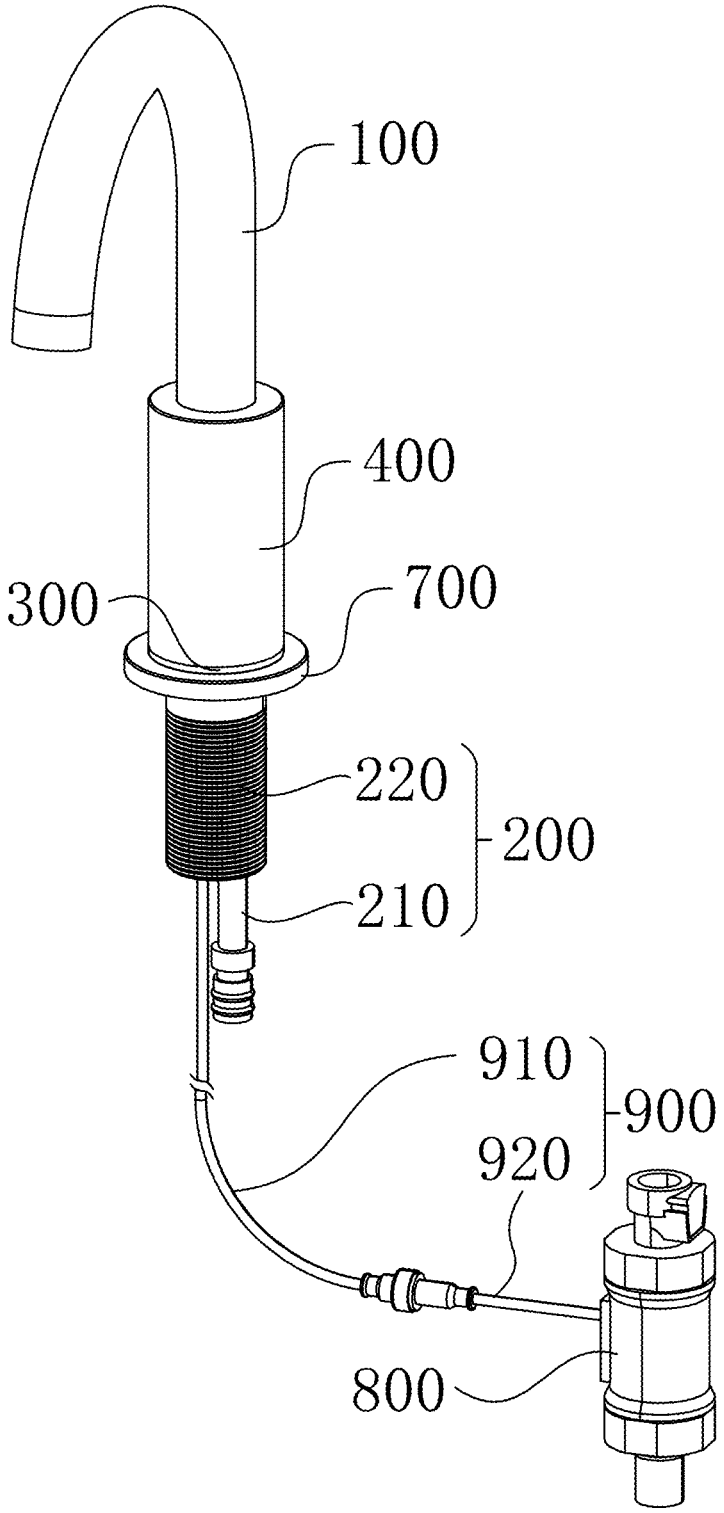
FIG. 1 is a perspective schematic diagram of a faucet of the present disclosure.

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all of the embodiments. Based on the embodiments of the present disclosure, all other embodiments obtained by those of ordinary skill in the art without creative work shall fall within the protection scope of the present disclosure.

Reference herein to "embodiment" or "implement" means that a particular feature, structure, or characteristic described in connection with one embodiment or one implement may be included in at least one embodiment of the present disclosure. The appearances of the "embodiment" in various positions in the specification are not necessarily referring to the same embodiment, and are not independent or alternative embodiments mutually exclusive of other embodiments. Those skilled in the art explicitly and implicitly understand that the embodiments described herein may be combined with other embodiments.

As shown in FIGS. 1-18, the present disclosure provides a faucet 10. The faucet 10 comprises a water inlet assembly 200, a water outlet assembly 100, and a display assembly 300. The water inlet assembly 200 is connected to and is communicated with the water outlet assembly 100. The display assembly 300 is mounted on an outer surface of the water inlet assembly 200 and/or an outer surface of the water outlet assembly 100. The display assembly 300 is configured for displaying, for example, displaying a predetermined brightness, and the predetermined brightness displayed by the display assembly 300 indicates a current water output state of the faucet 10. The predetermined brightness displayed by the display assembly 300 is described in detail below. Compared with a faucet without a display function in the prior art, the faucet 10 in the embodiment of the present disclosure is able to display the predetermined brightness, so that a user is able to conveniently obtain the current water outlet state of the faucet 10.

It should be noted that the faucet 10 in the embodiment is not limited thereto, and the faucet 10 may further comprise other components, for example, the faucet device 10 may further comprises a hot water outlet assembly and/or a cold water outlet assembly, and the hot water outlet assembly and/or the cold water outlet assembly may be connected to and communicated with the water inlet assembly 200 through a water pipe.

The water inlet assembly 200 and the water outlet assembly 100 are connected to each other. For example, the water inlet assembly 200 and the water outlet assembly 100 are sleeved with each other, or are inserted into each other, so that the water inlet assembly 200 is directly connected to and communicated with the water outlet assembly 100. Therefore, in a mounting process of the faucet 10 of the present disclosure, the water inlet assembly 200 and the water outlet assembly 100 are directly sleeved with each other, so that joints of the water inlet assembly 200 and the water outlet assembly 100 are reduced compared with a faucet in the prior art, and waterproof performance of the faucet 10 is improved.

In one embodiment, as shown in FIGS. 1, 2, 6 and 7, the water inlet assembly 200 comprises a water inlet pipe 210. The water outlet assembly 100 comprises a water outlet pipe 110. The water outlet pipe 110 is connected to the water inlet pipe 210. The water outlet pipe 110 is communicated with the water inlet pipe 210. For instance, a portion of the water inlet pipe 210 is sleeved on a portion of the water outlet pipe 110. That is, the water inlet pipe 210 is partially inserted into the water outlet pipe 110, so as to realize connection and communication between the water inlet pipe 210 and the water outlet pipe 110.

In one embodiment, the water outlet pipe 110 comprises a first sleeving portion 111 and a water outlet portion 112. The first sleeving portion 111 and the water outlet portion 112 are connected in sequence.

A first end of the first sleeving portion 111 is connected to a first end of the water outlet portion 112, a second end of the first sleeving portion 111 is connected to the water inlet pipe 210, and a second end of the water outlet portion 112 is capable of discharging water. Specifically, the first sleeving portion 111 and the water outlet portion 112 are made of a metal material, such as metal copper or stainless steel. It should be noted that materials of the first sleeving portion 111 and the water outlet portion 112 are not limited thereto.

In one embodiment, the first sleeving portion 111 and the water outlet portion 112 are integrally disposed.

In one embodiment, a diameter of the first sleeving portion 112 is not greater than a diameter of the water outlet portion 112. For instance, an outer diameter of the first sleeving portion 111 is equal to an outer diameter of a first portion of the water outlet portion 112, the outer diameter of the first sleeving portion 111 is less than an outer diameter of a second portion of the water outlet portion 112, and the second portion of the water outlet portion 112 is spaced apart from the first sleeving portion 111.

In one embodiment, the water outlet portion 112 is bent. A bending position and a bending degree of the water outlet portion 112 are determined according to user requirements, which is not limited in the embodiments of the present disclosure.

In one embodiment, the water outlet assembly 100 further comprises a nozzle 120, and the nozzle 120 is disposed on the second end of the water outlet portion 112. Specifically, the nozzle 120 is disposed in the water outlet portion 1120. It should be noted that components of the water outlet assembly 100 in the embodiments of the present disclosure are not limited to the water outlet pipe 110 and the nozzle 120, and the components of the water outlet assembly 100 are not limited thereto.

In one embodiment, the water inlet pipe 210 comprises a second sleeving portion 213, a third sleeving portion 212, and a water inlet portion 211. The second sleeving portion 213, the third sleeving portion 212, and the water inlet portion 211 are connected in sequence. A first end of the water inlet portion 211 is connected to a first end of the third sleeving portion 212, and a second end of the third sleeving portion 212 is connected to a first end of the second sleeving portion 213. A second end of the second sleeving portion 213 is connected to and communicated with a second end of the first sleeving portion 111. For instance, the second sleeving portion 213 is sleeved on the first sleeving portion 111. In other words, the first sleeving portion 111 is inserted into the second sleeving portion 213.

In one embodiment, as shown in FIGS. 1-2 and 8-9, the water inlet pipe 210 further comprises a water inlet 215, a water outlet 216, and a water inlet channel 217. The water inlet 215 is defined in a second end of the water inlet portion 211, and the water outlet 216 is defined in a second end of the second sleeving portion 213. The water inlet 215 is communicated with the water inlet channel 217, and the water outlet 216 is communicated with the water inlet channel 217.

In one embodiment, the second sleeving portion 213, the third sleeving portion 212, and the water inlet portion 211 are made of plastic materials. It should be noted that materials of the second sleeving portion 213, the third sleeving portion 212, and the water inlet portion 211 are not limited to the plastic materials, and may also be a metal material, such as the metal copper or the stainless steel.

In one embodiment, the second sleeving portion 213, the third sleeving portion 212, and the water inlet portion 211 are integrally disposed. Specifically, the second sleeving portion 213, the third sleeving portion 212, and the water inlet portion 211 are made of the plastic materials, and the second sleeving portion 213, the third sleeving portion 212, and the water inlet portion 211 are formed by injection molding.

A second end of the water inlet portion 211 is configured to connect to another water pipe. For instance, the water inlet portion 211 is connected to a hot water pipe and/or a cold water pipe. In order to improve the waterproof performance of the water inlet portion 211 in a process of connecting to another water pipe, limiting rings 201 are disposed on an outer surface of the water inlet portion 211, and each two adjacent limiting rings 201 of the limiting rings 201 define a fourth waterproof groove 2114.

In the embodiment, the present disclosure takes an example that the limiting rings are three limiting rings 201 for further illustration. The limiting rings 201 comprise a first limiting ring 2111, a second limiting ring 2112, and a third limiting ring 2113. The first limiting ring 2111, the second limiting ring 2112, and the third limiting ring 2113 are sequentially disposed at intervals from the second end of the water inlet portion 21 to the third sleeving portion 212.

Namely, the first limiting ring 2111, the second limiting ring 2112, and the third limiting ring 2113 are sequentially disposed at intervals from a free end of the water inlet portion 211 to the third sleeving portion 212. The limiting rings 201 define two fourth waterproof grooves 2114. Specifically, the first limiting ring 2111 and the second limiting ring 2112 define a first one of the two fourth waterproof grooves 2114, and the second limiting ring 2112 and the third limiting ring 2113 define a second one of the two fourth waterproof grooves 2114. The free end of the water inlet portion 211 is understood as the second end of the water inlet portion 211, that is, an end portion of the water inlet portion 211 away from the third sleeving portion 212.

In one embodiment, a maximum diameter of the third limiting ring 2113 is not less than a maximum diameter of the second limiting ring 2112, and the maximum diameter of the second limiting ring 2112 is not less than a maximum diameter of the first limiting ring 2111. For example, the maximum diameter of the third limiting ring 2113 is greater than the maximum diameter of the first limiting ring 2111.

In one embodiment, the maximum diameter of the third limiting ring 2113 is greater than the maximum diameter of the second limiting ring 2112, and the maximum diameter of the second limiting ring 2112 is equal to the maximum diameter of the first limiting ring 2111.

In one embodiment, a diameter of the first limiting ring 2111, a diameter of the second limiting ring 2112, and a diameter of the third limiting ring 2113 gradually increase in sequence. Specifically, the maximum diameter of the first limiting ring 2111 is less than the maximum diameter of the second limiting ring 2112, and the maximum diameter of the second limiting ring 2112 is less than the maximum diameter of the third limiting ring 2113.

In one embodiment, the diameter of the third limiting ring 2113 gradually increases from the free end of the water inlet portion 211 to the third sleeving portion 212. The maximum diameter of the third limiting ring 2113 is greater than the maximum diameter of the first limiting ring 2111 and the maximum diameter of the second limiting ring 2112, and a minimum diameter of the third limiting ring 2113 is equal to the maximum diameter of the first limiting ring 2111 and the maximum diameter of the second limiting ring 2112.

As shown in FIGS. 1-3 and 5, the faucet 10 further comprises fourth waterproof rings 640. The number of the fourth waterproof rings 640 is same as the number of the fourth waterproof grooves 2114, and the fourth waterproof rings 640 are one-to-one mounted in the fourth waterproof grooves 2114. In one embodiment, a maximum diameter of any one of the fourth waterproof rings 640 is greater than a maximum diameter of any one of the limiting rings 201. Namely, the maximum diameter of each of the fourth waterproof rings 640 is greater than the maximum diameter of the first limiting ring 2111, the maximum diameter of the second limiting ring 2112, and the maximum diameter of the third limiting ring 2113.

When the water inlet portion 211 is connected to the other water pipes (i.e., the other water pipes are sleeved on the water inlet portion), the other water pipes are respectively sleeved on the limiting rings 201 on the outer surface of the water inlet portion 211. Specifically, the other water pipes are respectively sleeved on the first limiting ring 2111, the second limiting ring 2112, and the third limiting ring 2113. The maximum diameter of the third limiting ring 2113 of the embodiment of the present disclosure is at least greater than the diameter of the first limiting ring 2111, so that a strength of the water inlet portion 211 is increased to a certain extent. Especially, the strength of the water inlet portion 211 increases on a direction toward the third sleeving portion 212, which ensures connection stability between the water inlet portion 211 and the other water pipes. Moreover, the maximum diameter of each of the fourth waterproof rings 640 in the embodiments of the present disclosure is greater than the maximum diameter of any one of the limiting rings 201. When the other water pipes are respectively sleeved on the fourth waterproof rings 640, the other water pipes are respectively attached to the fourth waterproof rings 640 to squeeze the fourth waterproof rings 640. As a result, the fourth waterproof rings 640 deform to improve the waterproof performance.

In one embodiment, an annular groove 2115 is defined in the outer surface of the water inlet portion 211, and the annular groove 2115 is disposed adjacent to the third limiting ring 2113. When the water inlet portion 211 are connected to the other water pipes, the other water pipe portions is allowed to be placed in the annular groove 2115, so that the other water pipes are fastened, which ensures that the other water pipes do not leak water after being sleeved on the water inlet portion 211.

Figure 6:
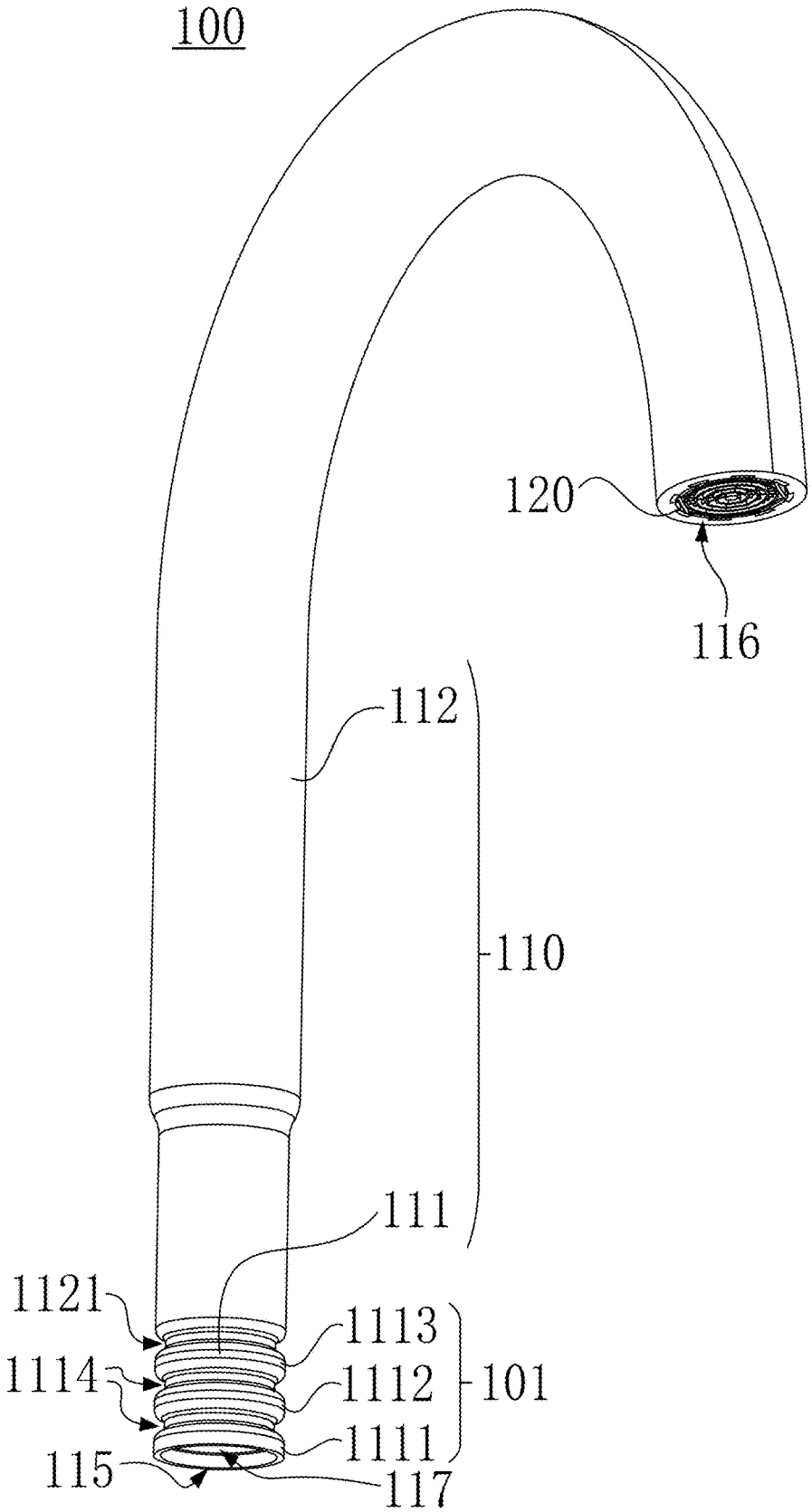
FIG. 6 is a perspective schematic diagram of a water outlet assembly of the faucet of the present disclosure.
Figure 7:
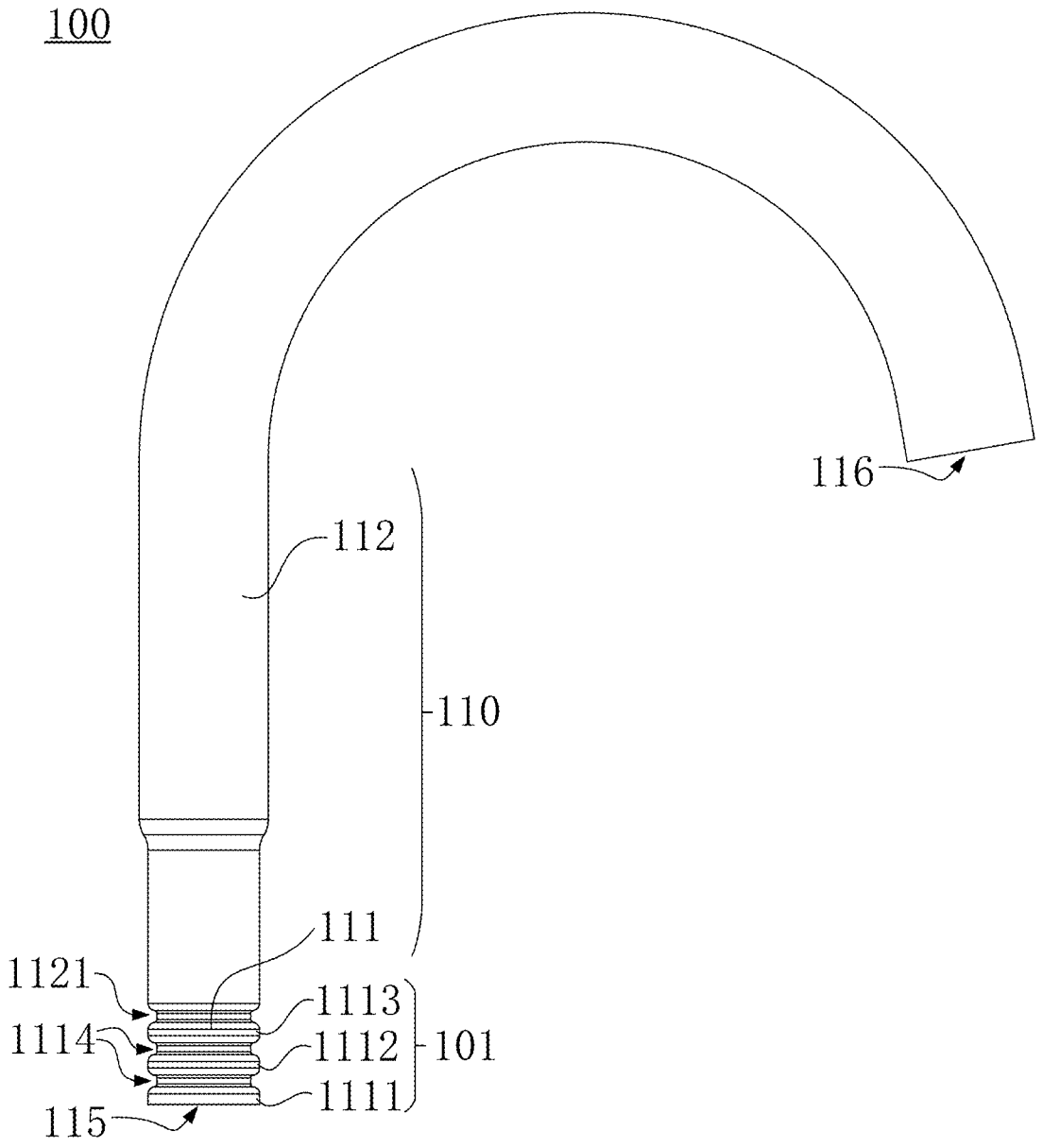
FIG. 7 is a side elevational schematic diagram of the water outlet assembly of the faucet of the present disclosure.
Figure 8:
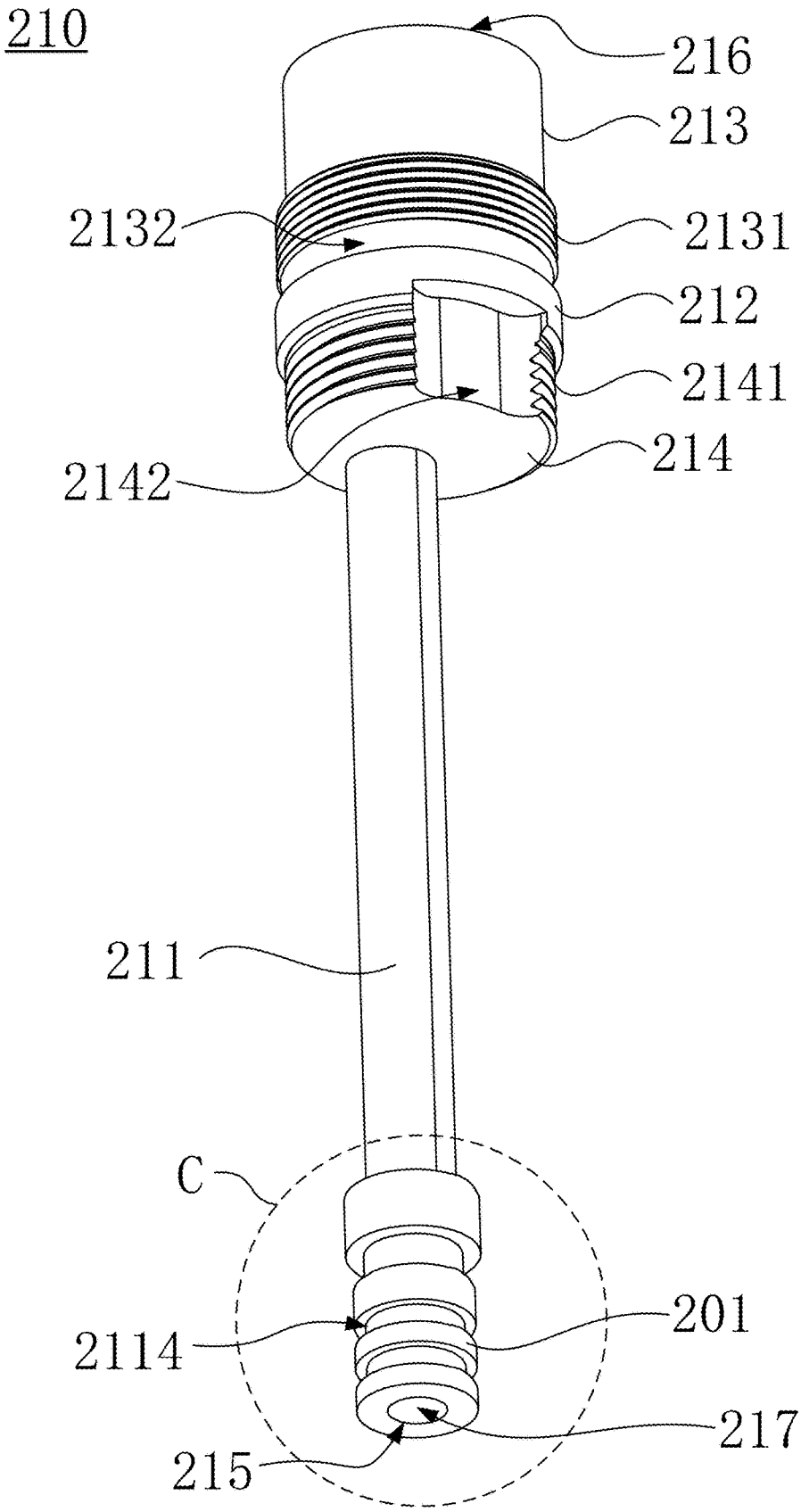
FIG. 8 is a perspective schematic diagram of a water inlet assembly of the faucet of the present disclosure.
Figure 9:
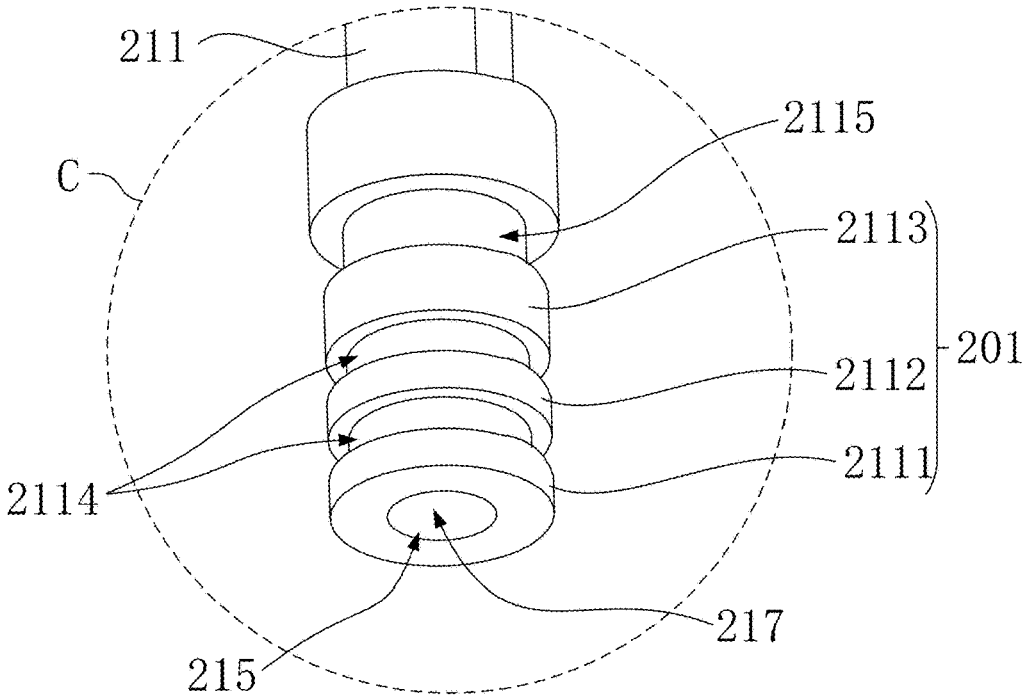
FIG. 9 is an enlarged schematic diagram of portion C shown in FIG. 8.

In one embodiment, as shown in FIGS. 6-7, limiting convex rings 101 are disposed on an outer surface of the first sleeving portion 111. Each two adjacent limiting convex rings 101 define a first waterproof groove 1114.

In the embodiment, the present disclosure takes an example that three limiting convex rings 101 are provided for further illustration. The limiting convex rings 101 comprise a first limiting convex ring 1111, a second limiting convex ring 1112, and a third limiting convex ring 1113. The first limiting convex ring 1111, the second limiting convex ring 1112, and the third limiting convex ring 1113 are sequentially disposed at intervals from the second end of the first sleeving portion 111 to the water outlet portion 112. Namely, the first limiting convex ring 1111, the second limiting convex ring 1112, and the third limiting convex ring 1113 are sequentially disposed at intervals from the free end of the first sleeving portion 111 to the water outlet portion 112. The three limiting convex rings 101 define two first waterproof grooves 1114. The first limiting convex ring 1111 and the second limiting convex ring 1112 define a first one of the two first waterproof grooves 1114, and the second limiting convex ring 1112 and the third limiting convex ring 1113 define a second one of the two first waterproof grooves 1114.

The free end of the first sleeving portion 111 is understood as the second end of the first sleeving portion 111, or the end portion of the first sleeving portion 111 away from the water outlet portion 112.

In one embodiment, a maximum diameter of the third limiting convex ring 1113 is not less than a maximum diameter of the second limiting convex ring 1112, and the maximum diameter of the second limiting convex ring 1112 is not less than a maximum diameter of the first limiting convex ring 1111. Specifically, the maximum diameter of the third limiting convex ring 1113 is greater than the maximum diameter of the first limiting convex ring 1111.

In one embodiment, the maximum diameter of the third limiting convex ring 1113 is greater than a diameter of the second limiting ring 2112, and the maximum diameter of the second limiting convex ring 1112 is equal to the maximum diameter of the first limiting convex ring 1111.

In one alternatively embodiment, a diameter of the first limiting convex ring 1111, the diameter of the second limiting convex ring 1112, and a diameter of the third limiting convex ring 1113 gradually increase in sequence. Specifically, the maximum diameter of the first limiting convex ring 1111 is less than the maximum diameter of the second limiting convex ring 1112, and the maximum diameter of the second limiting convex ring 1112 is less than the maximum diameter of the third limiting convex ring 1113.

In one embodiment, the diameter of the third limiting convex ring 1113 gradually increases from the free end of the first sleeving portion 111 to the water outlet portion 112. The maximum diameter of the third limiting convex ring 1113 is greater than the maximum diameter of the first limiting convex ring 1111 and the maximum diameter of the second limiting convex ring 1112. A minimum diameter of the third limiting convex ring 1113 is equal to the maximum diameter of the first limiting convex ring 1111 and the maximum diameter of the second limiting convex ring 1112.

Figure 2:
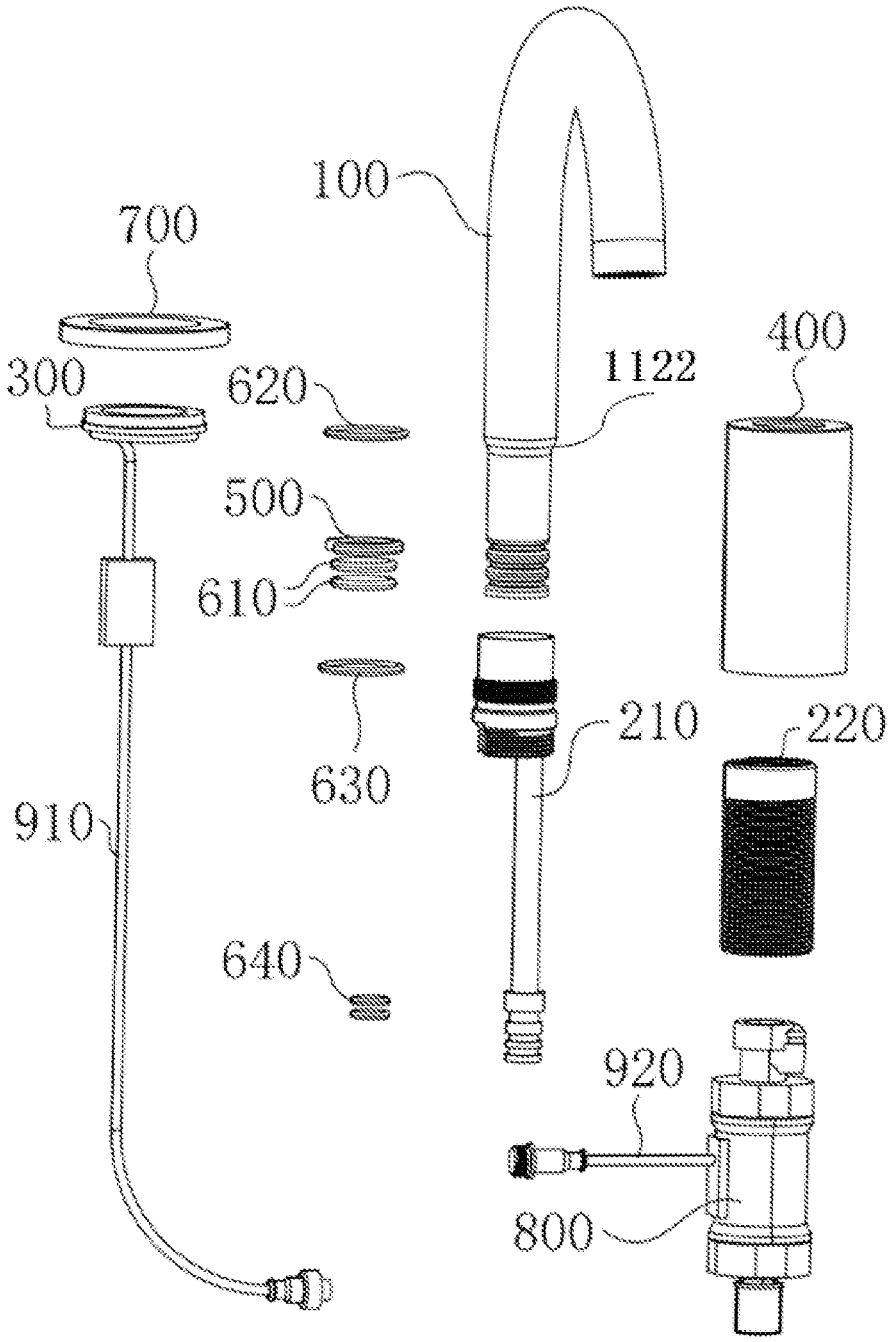
FIG. 2 is an exploded schematic diagram of the faucet of the present disclosure.
Figure 3:
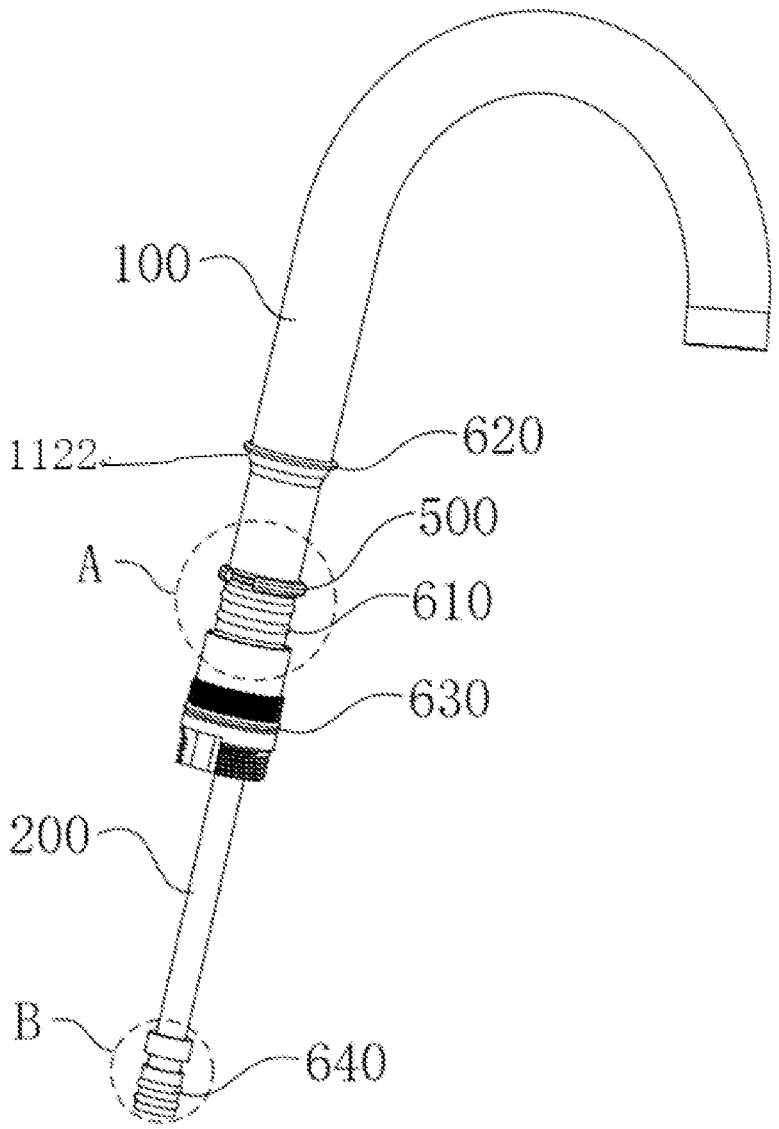
FIG. 3 is a schematic diagram of portions of the faucet of the present disclosure.
Figure 4:
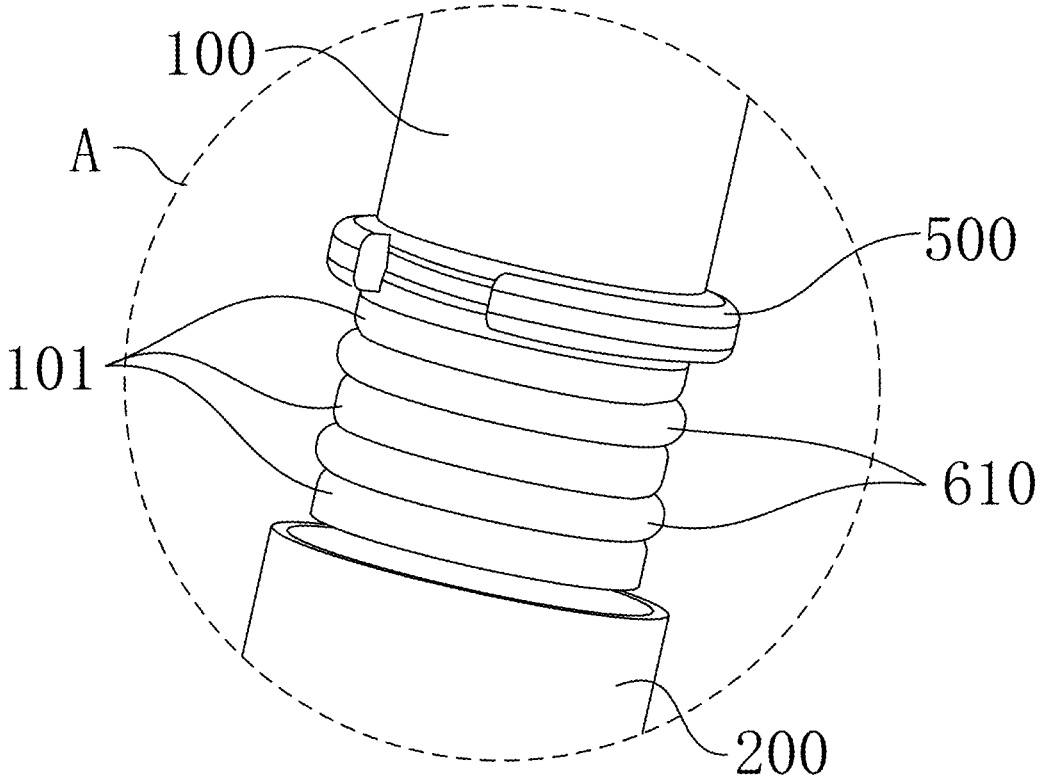
FIG. 4 is an enlarged schematic diagram of portion A shown in FIG. 3.
Figure 5:
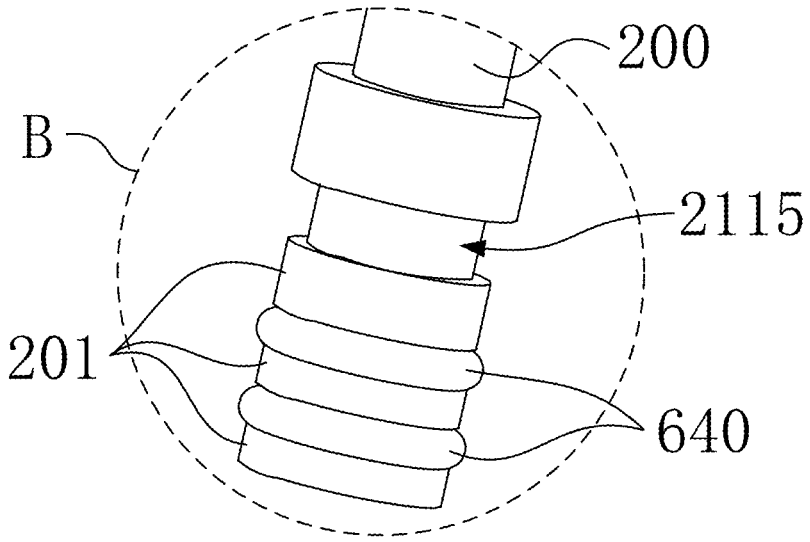
FIG. 5 is an enlarged schematic diagram of portion B shown in FIG. 3.

As shown in FIGS. 2-4, the faucet 10 further comprises first waterproof rings 610, the number of the third waterproof rings 610 is equal to the number of the first waterproof grooves 1114, and the first waterproof rings 610 are one-to-one mounted in the first waterproof grooves 1114. For example, a maximum diameter of any one of the first waterproof rings 610 is greater than the maximum diameter of any one of the limiting convex rings 101. Specifically, the maximum diameter of any one of the first waterproof rings 610 is greater than the maximum diameter of the first limiting convex ring 1111, the maximum diameter of the second limiting convex ring 1112, and the maximum diameter of the third limiting convex ring 1113.

In the process that the second sleeving portion 213 is sleeved on the first sleeving portion 111, the second sleeving portion 213 is sleeved on the limiting convex rings 101 on the outer surface of the first sleeving portion 111. Specifically, the second sleeving portion 213 is sleeved on the first limiting convex ring 1111, the second limiting convex ring 1112, and the third limiting convex ring 1113, and the second sleeving portion 213 is sleeved on the two first waterproof rings 610. In the embodiment, the maximum diameter of the third limiting convex ring 1113 is at least greater than the diameter of the first limiting convex ring 1111, so that a strength of the first sleeving portion 111 is increased to a certain extent. In particular, the closer to the water outlet portion 112, the greater the strength of the first sleeving portion 111 which ensures stability of the second sleeving portion 213 sleeved on the first sleeving portion 111. At the same time, the maximum diameter of any one of the first waterproof rings 610 is greater than the maximum diameter of any one of the limiting convex rings 101. When the second sleeving portion 213 is sleeved on the first waterproof rings 610, the second sleeving portion 213 is attached to the first waterproof rings 610 to squeeze the first waterproof rings 610 to deform, which improves the waterproof performance. Moreover, in the prior art, connecting pieces are introduced to connecting a conventional water inlet pile and a conventional water outlet pipe, which the water inlet pipe 210 and the water outlet pipe 110 of the present disclosure are directly sleeved with each other. As a result, joints between the water inlet pipe 210 and the water outlet pipe 110 are reduced, a possibility of water leakage is reduced, and the waterproof performance of the faucet 10 is improved.

In one embodiment, a limiting groove 121 is defined in an outer surface of the water outlet portion 112. The limiting groove 121 is disposed around the outer surface of the water outlet portion 112. The limiting groove 1121 is disposed on the first end of the water outlet portion 112, and the limiting groove 1121 is adjacent to the third limiting convex ring 1113.

As shown in FIGS. 2-4, the faucet 10 further comprises a limiting component 500 mounted in the limiting groove 1121. The limiting component 500 defines an opening 540 having a length slightly less than a diameter of the limiting groove 1121. The limiting component 500 further has a first end surface 520 and a second end surface 530 at two ends of a limiting body 510. The first end surface 520 and the second end surface 530 of the limiting body 510 are opposite to each other and are spaced apart from each other, and the opening 540 is defined between the first end surface 520 and the second end surface 530.

In one embodiment, a length of the opening 540 is slightly less than a diameter of the limiting groove 1121. The limiting component 500 is allowed to be mounted in the limiting groove 1121 through deformation of the opening 540. Specifically, the limiting component 500 deforms to be mounted in the limiting groove 1121 through deformation of the opening 540.

When the second sleeving portion 213 is sleeved on the first sleeving portion 111, the second sleeving portion 213 is stopped by the limiting component 500, and a free end of the second sleeving portion 213 abuts against (i.e., attached to) the limiting component 500.

In the embodiment, the second sleeving portion 213 is sleeved on the first sleeving portion 111, and the first waterproof rings 610 are disposed between the first sleeving portion 111 and the second sleeving portion 213, so that the waterproof performance of the first sleeving portion 111 and the second sleeving portion 213 is good.

In one embodiment, the water inlet pipe 210 further comprises a mounting portion 214 connected between the water inlet portion 211 and the third sleeving portion 212. The water inlet assembly 200 further comprises a mounting pipe 220, and the mounting pipe 220 is detachably connected to the mounting portion 214. Specifically, third connecting threads 2141 are disposed on an outer surface of the mounting portion 214. Fourth connecting threads 222 are disposed on an inner surface of the mounting pipe 220. The fourth connecting threads 222 are screwed with the third connecting threads 2141.

Figure 16:
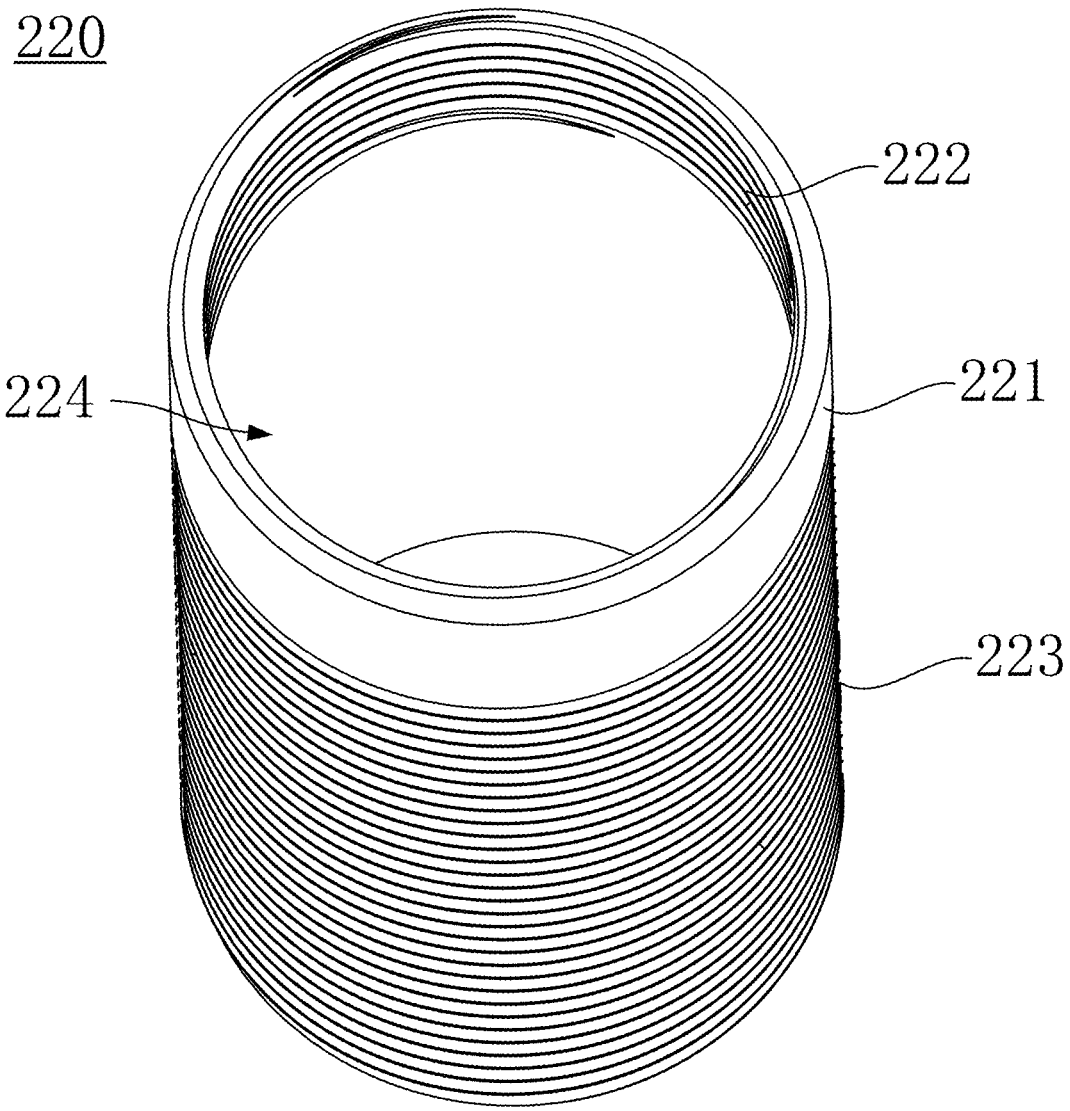
FIG. 16 is a perspective schematic diagram of a mounting pipe of the faucet of the present disclosure.

As shown in FIG. 16, the mounting pipe 220 comprises a mounting pipe body 221. The mounting pipe 220 further includes a first through hole 224 defined by the mounting pipe body 221, and the fourth connecting threads 222 are disposed on the inner surface of the mounting pipe body 221. The first through hole 224 is at least configured for accommodating the water inlet portion 211 and the mounting portion 214. Specifically, at least a portion of the water inlet portion 211 is located in the mounting pipe 220, and at least a portion of the water inlet portion 211 is located in the first through hole 224.

In one embodiment, external threads 223 are disposed on an outer surface of the mounting pipe 220. Specifically, the mounting pipe 220 comprises the external threads 223 disposed on an outer surface of the mounting pipe body 221

The mounting pipe 220 is configured to connect to an external mounting structure to mount the faucet 10 to a predetermined position. The external threads 223 are configured to be screwed with the external mounting structure. Optionally, the mounting pipe 220 is made of metal, such as metal copper.

In other optional embodiments, the mounting pipe 220 and the mounting portion 214 are integrally disposed.

In one embodiment, reinforcing ribs are disposed on the outer surface of the water inlet portion 211. The reinforcing ribs are disposed between the annular groove 2115 and the mounting portion 214, and the reinforcing ribs are connected to one end of the mounting portion 214, so that the strength of the water inlet portion 211 is increased. The number of the reinforcing ribs may be two, three, four, which are not further illustrated herein. The reinforcing ribs are disposed on the outer surface of the water inlet portion 211 at intervals. Optionally, the reinforcing ribs are disposed on the outer surface of the water inlet portion 211 at equal intervals.

In one embodiment, a size of each of the reinforcing ribs gradually increases from the free end of the water inlet portion 211 to the mounting portion 214. That is, a thickness of each of the reinforcing ribs gradually increases, and a width of each of the reinforcing ribs gradually increases. It is understood that the size of each of the reinforcing ribs may also be not changed.

In one embodiment, the mounting portion 214 and the third sleeving portion 212 jointly defines a notch 2142 for a wire 900 to pass through. The notch 2142 extends from one end of the mounting portion 214 away from the third sleeving portion 212 to the third sleeving portion 212. The notch 2142 penetrates through the mounting portion 214, and the notch 2142 does not penetrate through the third sleeving portion 212

In one embodiment, the display assembly 300 is partially mounted in the water inlet assembly 200 and/or the water outlet assembly 100. Specifically, the display assembly 300 is partially mounted on the outer surface of the water inlet assembly 200 and/or the outer surface of the water outlet assembly 100. The display assembly 300 is partially mounted on the outer surface of the water inlet assembly 200 and/or the outer surface of the water outlet assembly 100, which facilitates light displayed by the display assembly 300. The display assembly 300 is partially mounted in the water inlet assembly 200 and/or the water outlet assembly 100, so that connection stability of the display assembly 300 is improved, and the waterproof performance of the faucet device 10 is improved.

In other optional embodiments, the display assembly 300 is partially mounted in other components of the faucet 10, and the display assembly 300 is partially mounted on at least one of the outer surface of the water inlet assembly 200, the outer surface of the water outlet assembly 100, and the outer surface of another component of the faucet 10. The display assembly 300 is partially mounted in other components of the faucet device 10, so that the connection stability of the display assembly 300 is improved, and the waterproof performance of the faucet device 10 is improved.

In one embodiment, the display assembly 300 is sleeved on the water inlet pipe 210. Specifically, the display assembly 300 is sleeved on an outer surface of the third sleeving portion 212 of the water inlet pipe 210.

Figure 10:
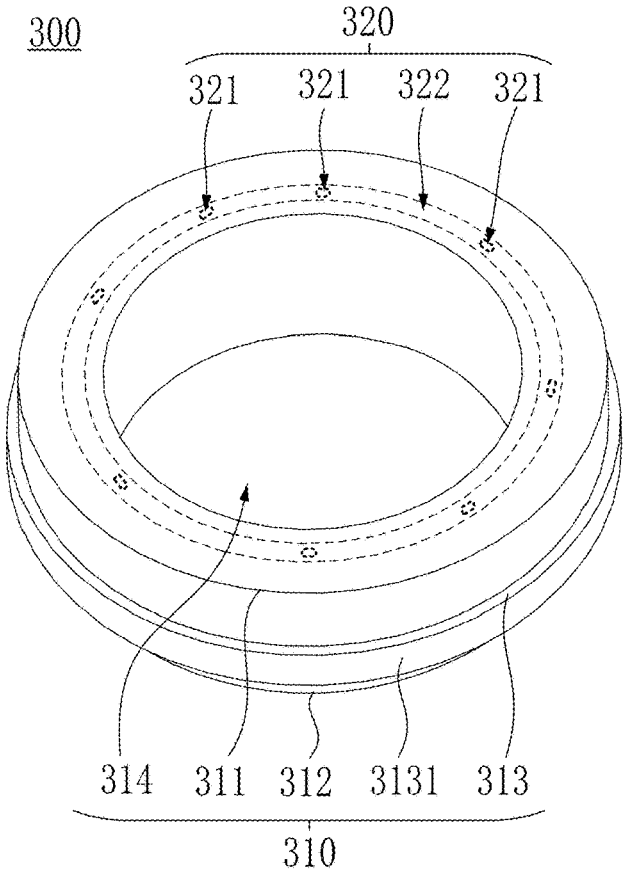
FIG. 10 is a perspective schematic diagram of a display assembly of the faucet of the present disclosure.
Figure 11:
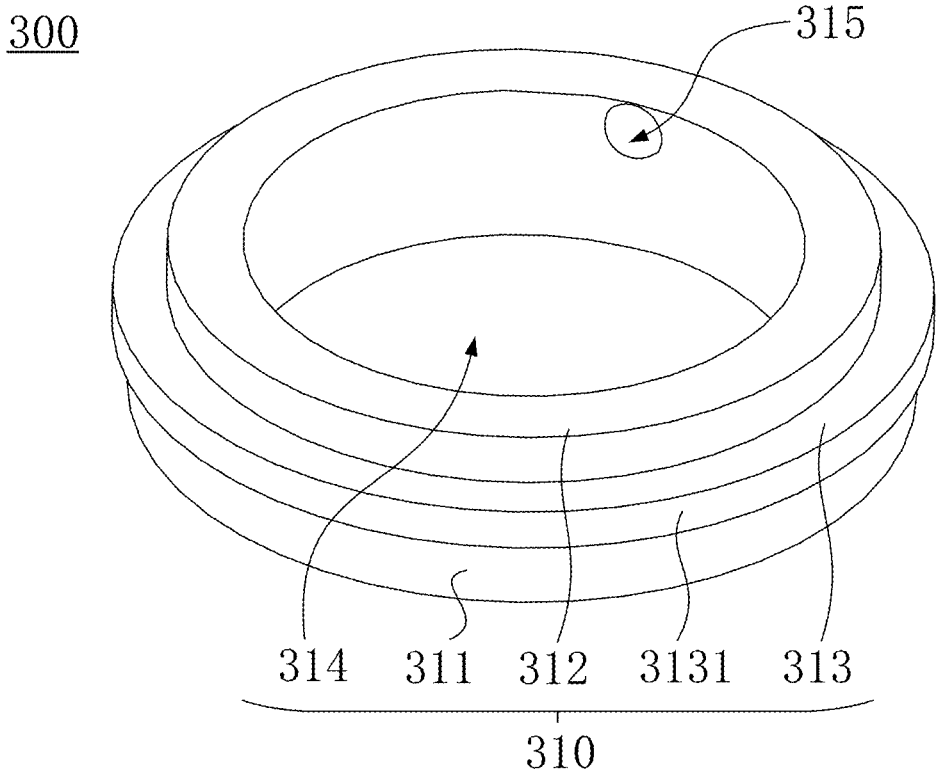
FIG. 11 is another perspective schematic diagram of the display assembly of the faucet of the present disclosure.
Figure 12:
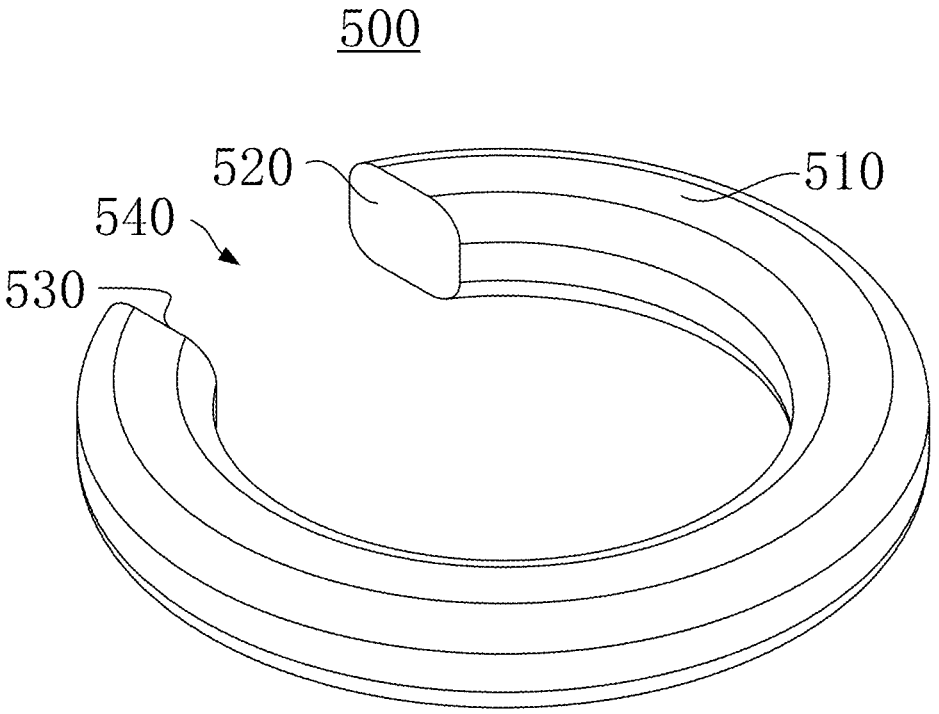
FIG. 12 is a perspective schematic diagram of a limiting component of the faucet of the present disclosure.

As shown in FIGS. 10-11, the display assembly 300 comprises a light-transmitting component 310 and a light-emitting component 320. The light-emitting component 320 is disposed in the light-transmitting component 310.

For example, the light-transmitting component 310 is formed around the light-emitting component 320 by injection molding. At least a portion of the light-transmitting component 310 is light-transmitting. The light-emitting component 320 is configured to emit light, and the light emitted by the light-emitting component 320 is transmitted to an outside of the faucet 10 through the light-transmitting component 310.

In one embodiment, the light-emitting component 320 comprises light sources 321 and a circuit board 322. The circuit board 322 and the light sources 321 are disposed in the light-transmitting component 310. The light sources 321 are disposed on the circuit board 322 at intervals, and the light sources 321 are electrically connected to the circuit board 322.

In one embodiment, as shown in FIGS. 1 and 2, the faucet 10 further comprises a hydroelectric generation assembly 800. The hydroelectric generation assembly 800 is disposed in one of the water pipes, and when water flows, water passing through the hydroelectric generation assembly 800 drives the hydroelectric generation assembly 800 to generate power. It is understood that the hydroelectric generation assembly 800 may be a hydroelectric generation assembly 800 in the prior art, which is not limited thereto. The hydroelectric generation assembly 800 is electrically connected to the circuit board 322 of the display assembly 300 through the wire 900. Specifically, the wire 900 comprises a first wire 910 and a second wire 920. The first wire 910 is electrically connected to the circuit board 322, and the first wire 910 is partially mounted on the outer surface of the water inlet portion 211.

In the embodiment, after the first wire 910 is electrically connected to the circuit board 322, the light-transmitting component 310 is formed around the circuit board 322 and the light sources 321, the light-transmitting component 310 defines a wiring hole 315 for the first wire 910 to pass through, so that the light-transmitting component 310 is connected to the first wire 910. The light-transmitting component 310 wraps the first wire 910 to seal the wiring hole 315. Furthermore, the first wire 910 and the light-transmitting component 310 may be bonded by glue to further seal the wiring hole 315.

The first wire 910 can sequentially pass through the notch 2142 and the first through hole 224, and is then electrically connected to the second wire 920. The second wire 920 is electrically connected to the hydroelectric generation assembly 800. Thus, the hydroelectric generation assembly 800 is able to supply power to the display assembly 300. Specifically, in a process that the hydroelectric generation assembly 800 supplies power to the display assembly 300, the light sources 321 display single light. Alternatively, in the process that the hydroelectric generation assembly 800 supplies the power to the display assembly 300, the light sources 321 display light of different colors. For example, the light sources 321 emit first color light when the faucet 10 discharges cold water, the light sources 321 emit second color light when the faucet 10 discharges hot water, and the first color light and the second color light are different. Optionally, the first color light is blue light, and the second color light is red light.

In order to further increase the connection stability between the first sleeving portion 111 and the second sleeving portion 213, the faucet 10 in the embodiment of the present disclosure further comprises a sleeve 400 partially sleeved on the water inlet pipe 210 and the water outlet pipe 110. The sleeve 400 covers a joint where the water outlet pipe 110 and the water inlet pipe 210 are connected. Optionally, the sleeve 400 is sleeved on the first sleeving portion 111 and the second sleeving portion 213. The second sleeving portion 213 is sleeved on the first sleeving portion 111, and the sleeve 400 is sleeved on the second sleeving portion 213 so as to be connected to the first sleeving portion 111. In one optional embodiment, the sleeve 400 is further partially sleeved on the water outlet portion 112 to cover a joint where the water outlet pipe 110 and the water inlet pipe 210 are connected.

Figure 13:
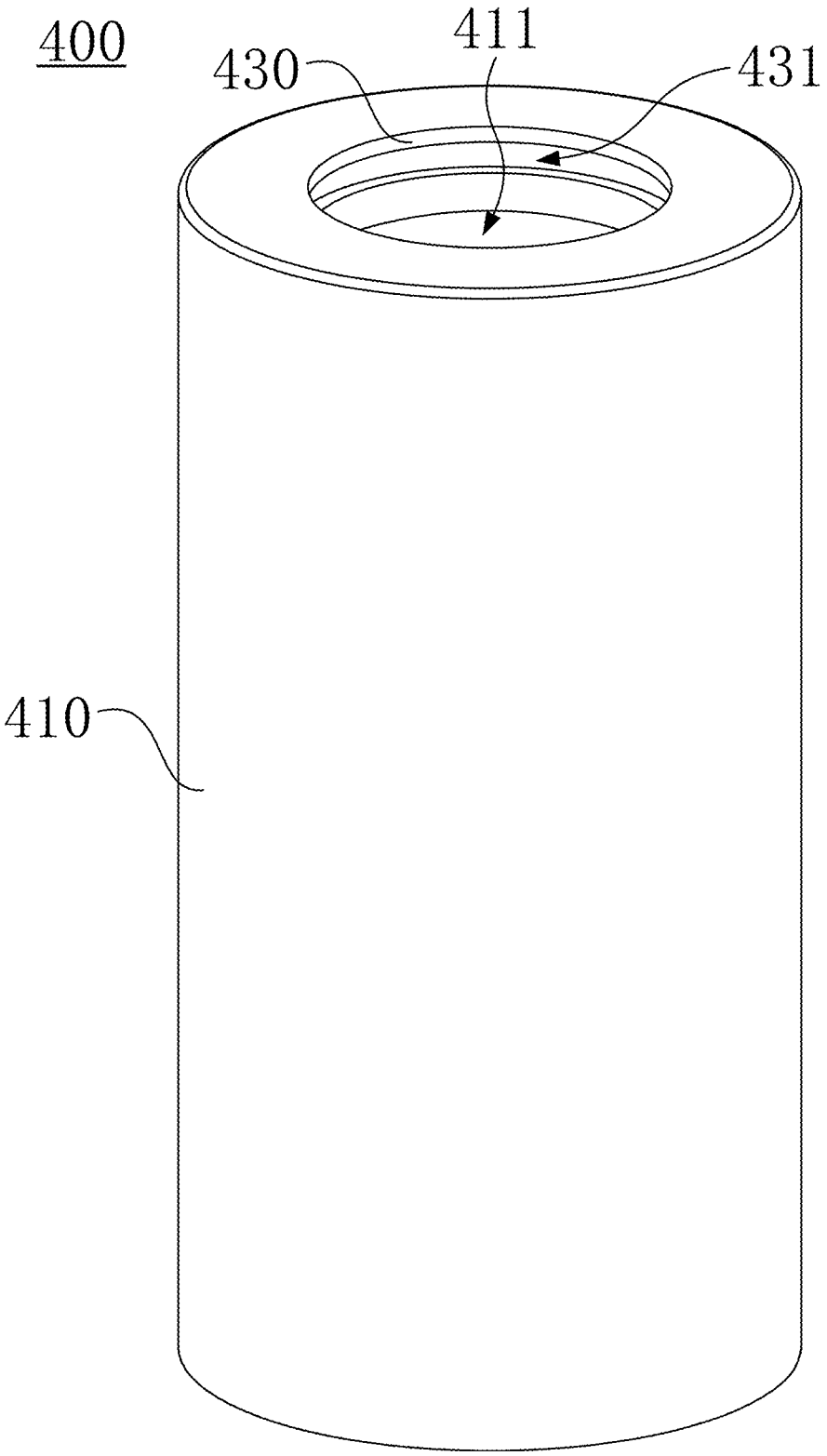
FIG. 13 is a perspective schematic diagram of a sleeve of the faucet of the present disclosure.
Figure 14:
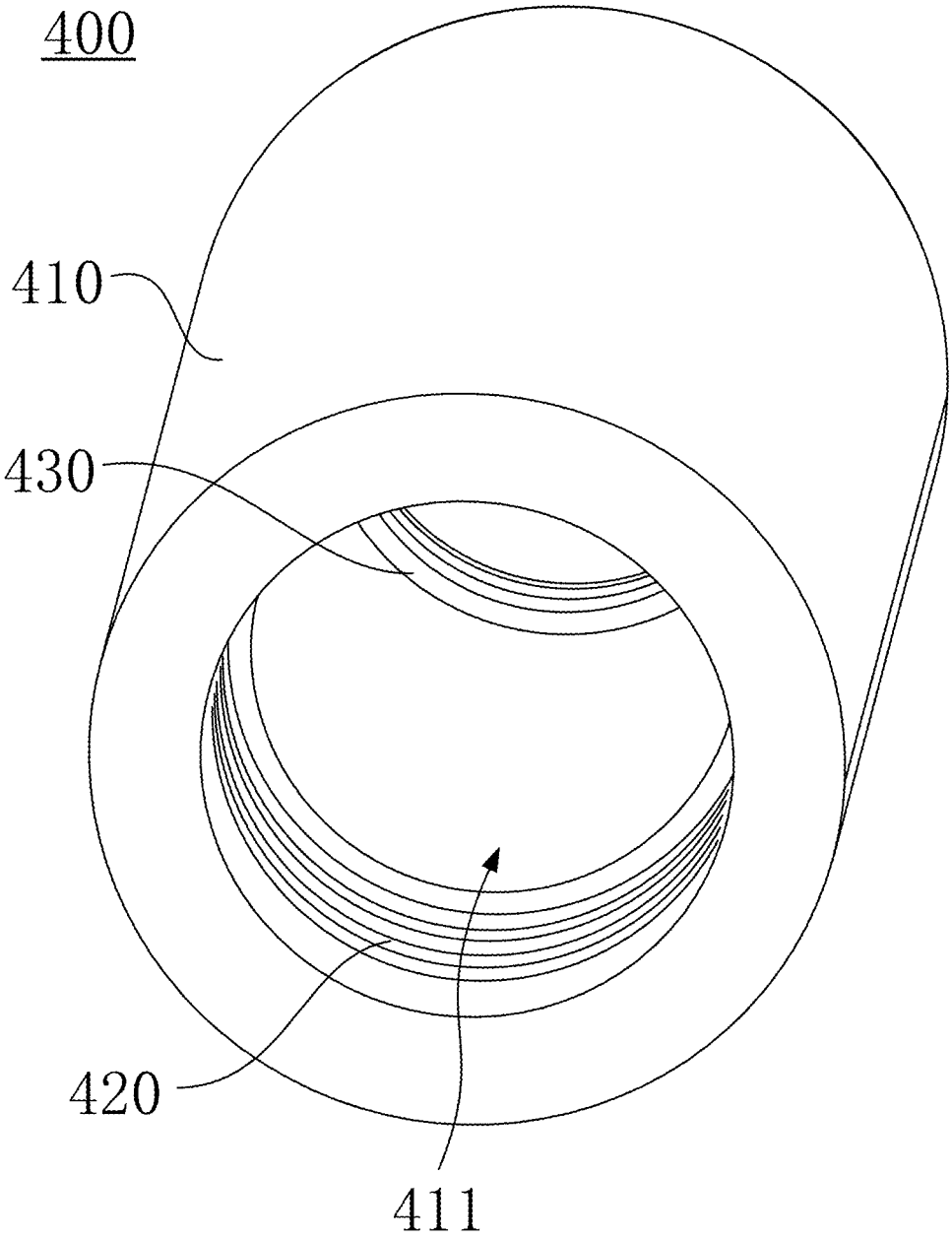
FIG. 14 is another perspective schematic diagram of the sleeve of the faucet of the present disclosure.
Figure 15:
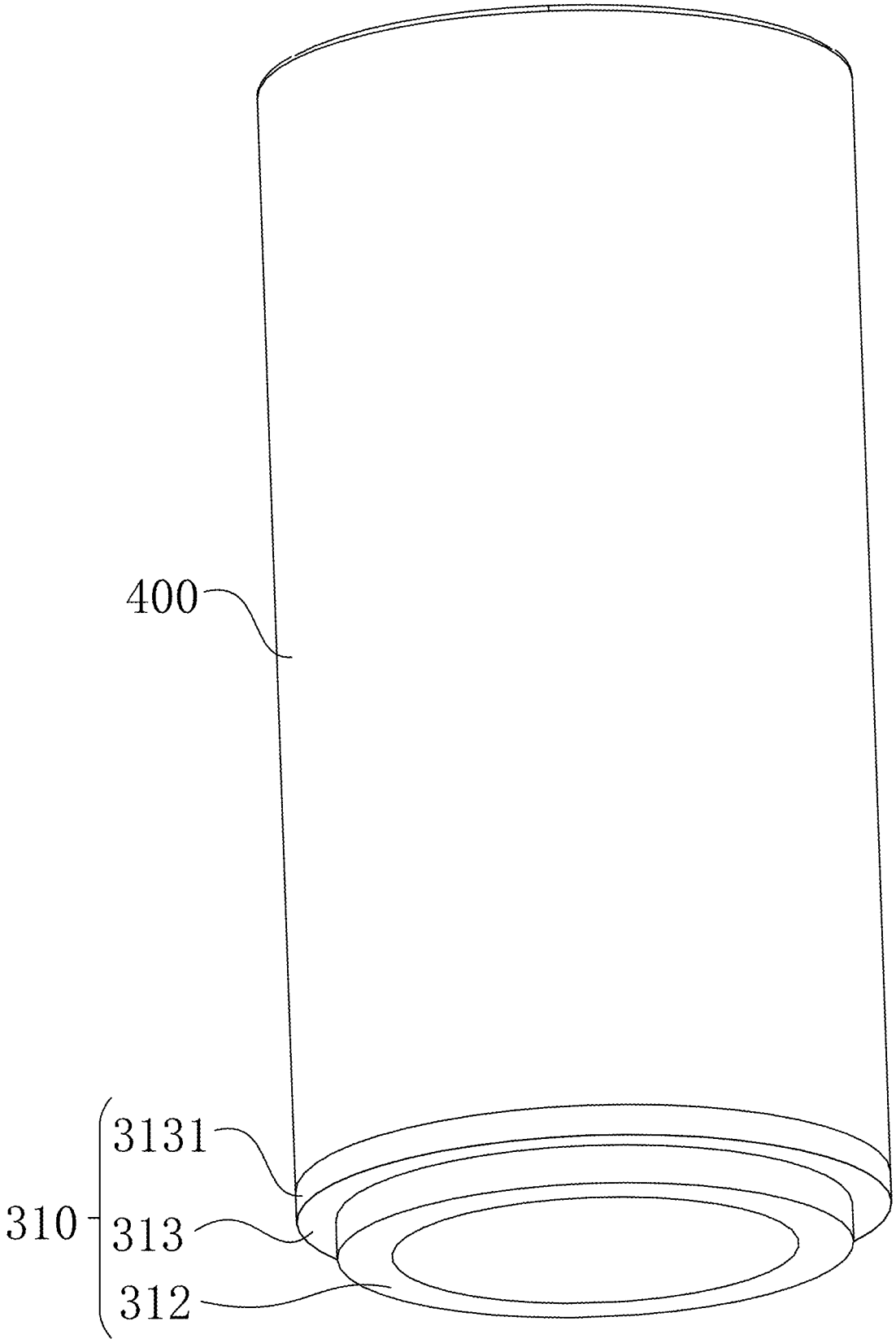
FIG. 15 is a structural schematic diagram of the sleeve and the display assembly of the faucet of the present disclosure, where the sleeve is connected to the display assembly.

As shown in FIGS. 13-15, the sleeve 400 is connected to at least one of the second sleeving portion 213 and the water outlet portion 112. Specifically, the sleeve 400 is connected to the second sleeving portion 213. For instance, the sleeve 400 comprises a sleeve body 410 and first connecting threads 420 disposed on an inner surface of the sleeve body 410. The sleeve 400 further comprises a second through hole 411 defined by the sleeve body 410. The second through hole 411 accommodates portions of the water outlet portion 112, the first sleeving portion 111 and the second sleeving portion 213. Second connecting threads 2131 are disposed on an outer surface of the second sleeving portion 213, and the first connecting threads 420 are screwed with the second connecting threads 2131.

A third waterproof groove 2132 is defined in the outer surface of the second sleeving portion 213, and the third waterproof groove 2132 is disposed around the outer surface of the second sleeving portion 213. The faucet 10 further comprises a third waterproof ring 630 mounted in the third waterproof groove 2132, the sleeve 400 is further sleeved on the third waterproof ring 630, and the sleeve 400 is attached to the third waterproof ring 630. The sleeve 400 is sleeved on the second sleeving portion 213 and the water outlet portion 112, so that the connection stability between the water inlet pipe 210 and the water outlet pipe 110 is improved, and the waterproof performance is improved. Therefore, a second waterproof design of the connection of the water inlet pipe 210 and the water outlet pipe 110 is realized to greatly improve the waterproof performance.

The third waterproof groove 2132 is located between the second sleeving portion 213 and the second connecting threads 2131. Specifically, a maximum diameter of the third waterproof ring 630 is not less than a maximum diameter of the second sleeving portion 213. For example, the maximum diameter of the third waterproof ring 630 is not less than the maximum diameter of the second connecting thread 2131.

It should be noted that the third waterproof groove 2132 may be disposed on the third sleeving portion 212. For example, the third waterproof groove 2132 is defined in the third sleeving portion 212, the maximum diameter of the third waterproof ring 630 is slightly greater than the maximum diameter of the third sleeving portion 212, and the light-transmitting component 310 is sleeved on the third waterproof ring 630.

In one embodiment, a flange 430 is disposed on one end of the sleeve 400. The flange 430 is disposed around the sleeve 400. A second waterproof groove 431 is defined in an inner surface of the flange 430, and the second waterproof groove 431 is disposed around the inner surface of the flange 430. The faucet 10 further comprises a second waterproof ring 620 mounted in the second waterproof groove 431, and a minimum diameter of the second waterproof ring 620 is slightly less than a minimum diameter of the flange 430.

The flange 430 and the second waterproof ring 620 are jointly sleeved on the water outlet portion 112, and the second waterproof ring 620 is attached to an arc step 1122 of the water outlet portion 112. Therefore, not only the connection stability of the water inlet pipe 210 and the water outlet pipe 110 is improved, but also the waterproof performance of the faucet 10 is improved. The second waterproof design of the connection between the water inlet pipe 210 and the water outlet pipe 110 is realized, so that the waterproof performance is greatly improved.

In one embodiment, the light-transmitting component 310 is sleeved on the water inlet pipe 211. Optionally, the light-transmitting component 310 is sleeved on the second sleeving portion 213.

In one embodiment, the light-transmitting component 310 comprises a first mounting portion 311 and a light-transmitting portion 313. The first mounting portion 311 is connected to the light-transmitting portion 313, for example, the first mounting portion 311 and the light-transmitting portion 313 are integrally formed. In one embodiment, the light-transmitting portion 313 protrudes from a periphery of the first mounting portion 311. The sleeve 400 is further sleeved on the first mounting portion 311. One end of the sleeve 400 away from the water outlet pipe 110 is adjacent to the light-transmitting portion 313, such as the one end of the sleeve 400 away from the water outlet pipe 110 is attached to the light-transmitting portion 313.

In one embodiment, an outer diameter of the light-transmitting portion 313 is equal to an outer diameter of the sleeve 400, so that a light-transmitting surface 3131 of the light-transmitting portion 313 is flush with an outer surface of the sleeve 400.

In one embodiment, the light-transmitting component 310 further comprises a second mounting portion 312. The second mounting portion 312, is connected to the light-transmitting portion 313. For example, the second mounting portion 312 and the light-transmitting portion are integrally formed. In one embodiment, the light-transmitting portion 313 protrudes from a periphery of the second mounting portion 312. The first mounting portion 311 and the second mounting portion 312 are located on two opposite sides of the light-transmitting portion 313.

The light-transmitting component 310 further comprises a third through hole 314, the third through hole 314 is communicated with the wiring hole 315, and the third through hole 314 is communicated with the notch 2142, so that the third through hole 315 is communicated with the notch 2142, and the first wire 910 is electrically connected to the second wire 920.

Figure 17:
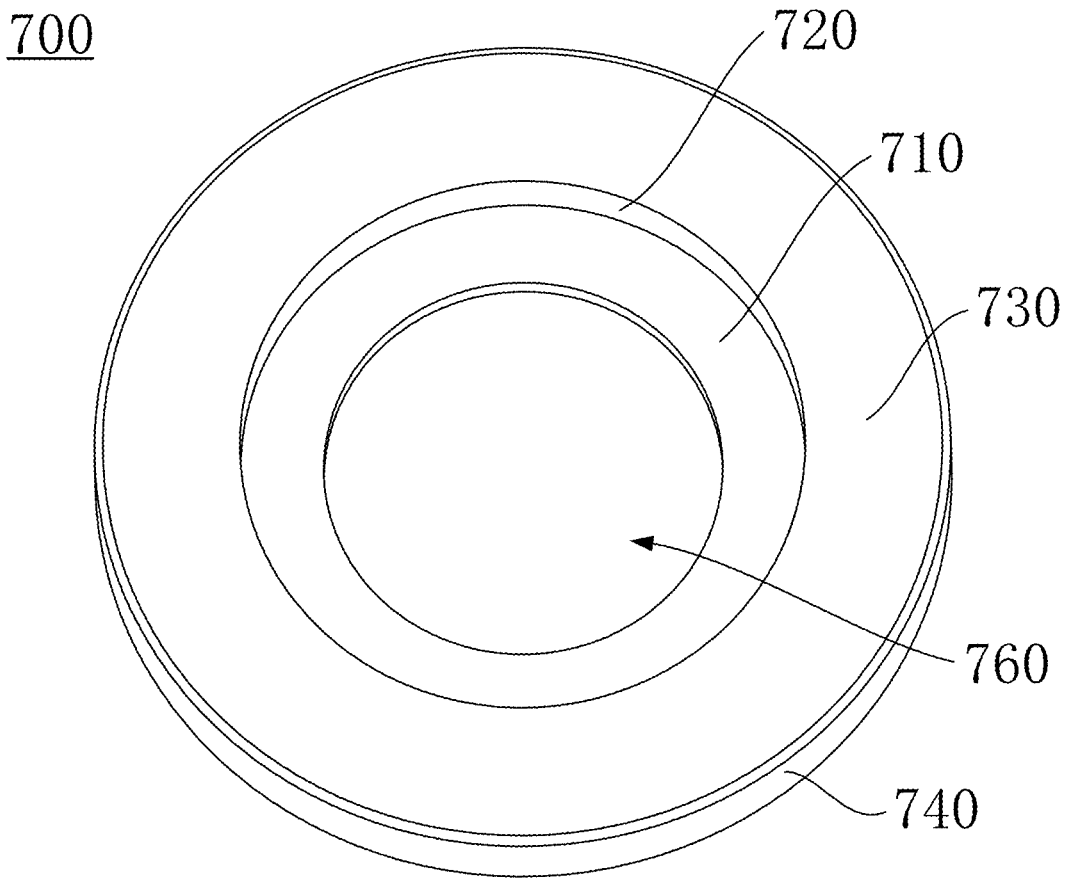
FIG. 17 is a perspective schematic diagram of a mounting gasket of the faucet of the present disclosure.
Figure 18:
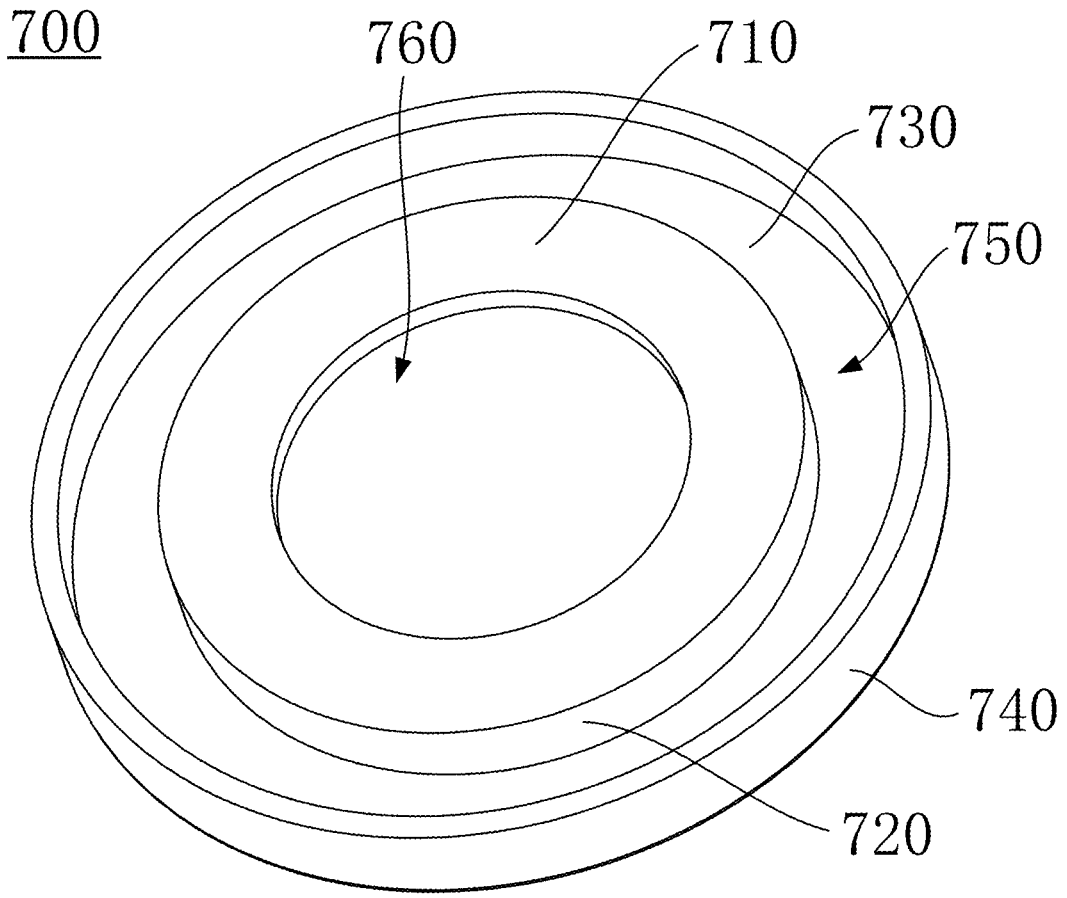
FIG. 18 is another perspective schematic diagram of the mounting gasket of the faucet of the present disclosure.

In one embodiment, the faucet 10 further comprises a mounting gasket 700. As shown in FIGS. 17-18, the mounting gasket 700 comprises a first mounting ring 710, a second mounting ring 720, a third mounting ring 730, and a fourth mounting ring 740 that are connected in sequence. The first mounting ring 710, the second mounting ring 720, the third mounting ring 730, and the fourth mounting ring 740 are integrally formed. The first mounting ring 710 is sleeved on a portion of the water inlet pipe 210. Specifically, the first mounting ring 710 is sleeved on the second sleeve portion 213. The second mounting ring 720 is sleeved on the second mounting portion 312, and the second mounting ring 720 is substantially perpendicular to the first mounting ring 710. The third mounting ring 730 is substantially perpendicular to the second mounting ring 720, and the fourth mounting ring 740 is substantially perpendicular to the third mounting ring 730. The second mounting ring 720, the third mounting ring 730 and the fourth mounting ring 740 jointly define a mounting groove 750. The mounting groove 750 is defined in a surface of the mounting gasket 700 away from the light-transmitting portion 313. The second mounting ring 720 and the first mounting ring 710 are surrounded by the fourth mounting ring 740.

The light-transmitting surface 3131 of the light-transmitting portion 313 is located between the fourth mounting ring 740 and the sleeve 400. The light emitted by the light sources 321 is transmitted from the light-transmitting surface 3131 to the outside through the light-transmitting portion 313.

The mounting gasket 700 further defines a fourth through hole 760, and the fourth through hole 760 is configured to accommodate the second sleeving portion 213. The fourth through hole 760 is communicated with the notch 2142, so that the first wire 910 is electrically connected to the second wire 920.

After the water inlet portion 211 is connected to the other water pipes, the water flows into the water inlet portion 211 through the other water pipes. Then, the water sequentially enters the mounting portion 214, the third sleeving portion 212, the first sleeving portion 111, and the water outlet portion 112 through the water inlet portion 211, and finally flows out from a water outlet 116. It is understood that, after the water inlet portion 211 is connected to the other water pipes, the water is allowed to flow into the water inlet 215 through the other water pipes, flow into an inlet 115 through the water inlet channel 217, and flow out from the water outlet 116 through a water outlet channel 117.

What is claimed is:

1. A faucet, comprising:

a water inlet assembly;

a water outlet assembly; and a display assembly;

wherein the water inlet assembly comprises a water inlet pipe, the water outlet assembly comprises a water outlet pipe, the water outlet pipe and the water inlet pipe are directly sleeved with each other, and the water outlet pipe is communicated with the water inlet pipe;

wherein the display assembly comprises a light-transmitting component and a light-emitting component, the light-emitting component is disposed in the light-transmitting component, the light-transmitting component is mounted on an outer surface of the water inlet pipe and/or an outer surface of the water outlet pipe; and a light-transmitting surface of the light-transmitting component is exposed;

wherein the faucet further comprises a sleeve, the sleeve is sleeved on a portion of the water inlet pipe and a portion of the water outlet pipe, the sleeve covers a joint where the water outlet pipe and the water inlet pipe are connected, and the light-transmitting component is mounted on any one of the outer surface of the water inlet pipe, the outer surface of the water outlet pipe, and an outer surface of the sleeve, wherein the one end of the sleeve away from the water outlet pipe is directly attached to the light-transmitting component;

wherein the water outlet pipe comprises a first sleeving portion and a water outlet portion, and the first sleeving portion and the water outlet portion are connected in sequence;

wherein the water inlet pipe comprises a second sleeving portion, a third sleeving portion, and a water inlet portion, wherein the second sleeving portion, the third sleeving portion, and the water inlet portion are connected in sequence, the second sleeving portion is sleeved on the first sleeving portion, the sleeve is sleeved on the second sleeving portion and a portion of the water outlet portion, and the light-transmitting component is sleeved on the third sleeving portion;

wherein limiting convex rings are disposed on an outer surface of the first sleeving portion, and each two adjacent limiting convex rings define a first waterproof groove;

wherein the faucet further comprises at least one first waterproof ring mounted in each first waterproof groove, a maximum diameter of the at least one first waterproof ring is greater than a maximum diameter of any one of the limiting convex rings, and the second sleeving portion is sleeved on the at least one first waterproof ring;

wherein a flange is disposed at one end, away from the second sleeving portion, of the sleeve, wherein the flange is disposed around the sleeve, a second waterproof groove is defined in an inner surface of the flange, the second waterproof groove is disposed around the inner surface of the flange, the faucet further comprises a second waterproof ring mounted in the second waterproof groove, a minimum diameter of the second waterproof ring is less than a minimum diameter of the flange, the flange and the second waterproof ring are sleeved on the water outlet portion, and the second waterproof ring is attached to the water outlet portion.

2. The faucet according to claim 1, wherein the light-transmitting component is sleeved on the water inlet pipe, the light-transmitting component comprises a first mounting portion and a light-transmitting portion, the first mounting portion is connected to the light-transmitting portion, the light-transmitting portion protrudes from a periphery of the first mounting portion, the sleeve is further sleeved on the first mounting portion, and one end of the sleeve away from the water outlet pipe is adjacent to the light-transmitting portion.

3. The faucet according to claim 2, wherein the one end of the sleeve away from the water outlet pipe is attached to the light-transmitting portion.

4. The faucet according to claim 2, wherein an outer diameter of the light-transmitting portion is equal to an outer diameter of the sleeve.

5. The faucet according to claim 2, wherein the light-transmitting component further comprises a second mounting portion connected to the light-transmitting portion, the light-transmitting portion protrudes from a periphery of the second mounting portion; the first mounting portion and the second mounting portion are located on two opposite sides of the light-transmitting portion, the faucet further comprises a mounting gasket, and the mounting gasket is sleeved on the water inlet pipe and the second mounting portion.

6. The faucet according to claim 5, wherein the mounting gasket comprises a first mounting ring, a second mounting ring, a third mounting ring, and a fourth mounting ring;

wherein the first mounting ring is sleeved on the water inlet pipe, the second mounting ring is connected to the first mounting ring, the second mounting ring is substantially perpendicular to the first mounting ring, the second mounting ring is sleeved on the second mounting portion, the third mounting ring is connected to the second mounting ring, the third mounting ring is substantially perpendicular to the second mounting ring, and the fourth mounting ring is connected to the third mounting ring, and the fourth mounting ring is substantially perpendicular to the third mounting ring;

wherein the second mounting ring, the third mounting ring, and the fourth mounting ring jointly define a mounting groove, the mounting groove is defined in a surface of the mounting gasket away from the light-transmitting portion, and the fourth mounting ring surrounds the first mounting ring and the second mounting ring.

7. The faucet according to claim 1, wherein the limiting convex rings comprise a first limiting convex ring, a second limiting convex ring, and a third limiting convex ring;

wherein the first limiting convex ring, the second limiting convex ring and the third limiting convex ring are sequentially disposed at intervals from a free end of the first sleeving portion to the water outlet portion;

wherein a maximum diameter of the third limiting convex ring is not less than a maximum diameter of the second limiting convex ring, the maximum diameter of the second limiting convex ring is not less than a maximum diameter of the first limiting convex ring, and the maximum diameter of the third limiting convex ring is greater than the maximum diameter of the first limiting convex ring.

8. The faucet according to claim 7, wherein a diameter of the third limiting convex ring gradually increases from the free end of the first sleeving portion to the water outlet portion, the maximum diameter of the third limiting convex ring is greater than the maximum diameter of the second limiting convex ring.

9. The faucet according to claim 7, wherein the maximum diameter of the first limiting convex ring, the maximum diameter of the second limiting convex ring, and the maximum diameter of the third limiting convex ring gradually increases in sequence.

10. The faucet according to claim 7, wherein a limiting groove is defined in an outer surface of the water outlet portion, the limiting groove is disposed around the outer surface of the water outlet portion, the faucet further comprises a limiting component mounted in the limiting groove, the limiting component defines an opening having a length slightly less than a diameter of the limiting groove, the limiting component is allowed to be mounted in the limiting groove through deformation of the opening, and the second sleeving portion is attached to the limiting component.

11. The faucet according to claim 1, wherein first connecting threads are disposed on an inner surface of the sleeve, second connecting threads are disposed on an outer surface of the second sleeving portion, and the second connecting threads are screwed with the first connecting threads.

12. The faucet according to claim 1, wherein a third waterproof groove is defined in the second sleeving portion or the third sleeving portion, the third waterproof groove is disposed around an outer surface of the second sleeving portion or an outer surface of the third sleeving portion, the faucet further comprises a third waterproof ring mounted in the third waterproof groove, a maximum diameter of the third waterproof ring is greater than a maximum diameter of the second sleeving portion or a maximum diameter of the third sleeving portion, and the light-transmitting component is sleeved on the third waterproof ring or the sleeve is sleeved on the third waterproof ring.

13. The faucet according to claim 1, wherein the water inlet pipe further comprises a mounting portion connected between the water inlet portion and the third sleeving portion, the water inlet assembly further comprises a mounting pipe detachably connected to the mounting portion, external threads are disposed on an outer surface of the mounting pipe, and the water inlet portion is at least partially disposed in the mounting pipe.

14. The faucet according to claim 13, wherein third connecting threads are disposed on an outer surface of the mounting portion, fourth connecting threads are disposed on an inner surface of the mounting pipe, and the fourth connecting threads are screwed with the third connecting threads.

15. The faucet according to claim 13, wherein the mounting portion and the third sleeving portion jointly defines a notch for a wire to pass through, and the wire is electrically connected to the light-emitting component.

16. The faucet according to claim 15, wherein the faucet further comprises a hydroelectric generation assembly, the hydroelectric generation assembly and the light-emitting component are electrically connected through the wire, the wire passes through the mounting pipe and the notch, and the wire is partially mounted on an outer surface of the water inlet portion.

17. The faucet according to claim 1, wherein the second waterproof ring is spaced from the at least one first waterproof ring, and the second waterproof ring is attached to an arc step of the water outlet portion.

18. The faucet according to claim 1, wherein the second waterproof ring is an assembly element different from the sleeve.

* * * * *